United States Patent [19]

Norsworthy

[11] Patent Number: 4,984,797

[45] Date of Patent: Jan. 15, 1991

[54] GAME BOX

[76] Inventor: John A. Norsworthy, 677 Laverendrye Drive, Gloucester, Ontario, K1J 7X5, Canada

[21] Appl. No.: 371,534

[22] Filed: Jun. 26, 1989

[30] Foreign Application Priority Data

Dec. 21, 1988 [CA] Canada ..... 586630

[51] Int. Cl.[5] ..... A63F 9/04

[52] U.S. Cl. ..... 273/145 C; 273/145 R

[58] Field of Search ..... 273/145

[56] References Cited

U.S. PATENT DOCUMENTS 2,724,595 11/1955 Amann ..... 273/145 A
4,805,908 2/1989 Auclair et al. ..... 273/145 C
4,826,170 5/1989 Rattai ..... 273/145

FOREIGN PATENT DOCUMENTS 2939802 4/1981 Fed. Rep. of Germany ... 273/145 C

*Primary Examiner*—Edward M. Coven

*Assistant Examiner*—Raleigh W. Chiu

*Attorney, Agent, or Firm*—Mason, Fenrick & Lawrence

[57] ABSTRACT

There is provided a new and useful game apparatus comprising a container and a lid therefor, the container having therein a shaker section and a shelf section; the shelf section substantially isolated from the shaker section when the lid is in position on the container and having a bottom which is spaced a predetermined distance from the top of the container such that, when the lid is in place, a die lying on the shelf is restrained against movement when the apparatus is shaken. In one embodiment the apparatus includes an integral illumination system for illuminating the interior of the container. In another embodiment the lid is hingedly connected to the container and includes a pair of protruding webs extending downwardly from the lid adjacent the hinged connection, the webs extending into the container when the lid is in the closed position, and blocking a lateral line of vision into the container when the lid is in the open position.

16 Claims, 2 Drawing Sheets

GAME BOX

This application relates to an apparatus for playing a game and, in particular, for playing the game known as "Liar's Dice".

BACKGROUND OF THE INVENTION

The game of Liar's Dice is a variation on the dice game commonly known as Bluff Dice or Blind Man's Bluff. The game is capable of becoming a very popular one, by virtue of its portability and its interest to players over a wide age spread. There are, however, certain requirements of the game per se which have not been adequately met by available apparatus for playing the game, so that its popularity to date has been somewhat limited.

Among these peculiarities of the game is the fact that a group of five dice must be shaken and must then be capable of being visible to the player who has shaken them but not to any of the other players. As well, it is necessary to be able to isolate from among the dice one or more of them which will then not be shaken with a subsequent dice shake but which must be isolated from the view of players other than the player who so isolated the dice.

Apparatus essentially in the form of boxes have been devised which accomplish the objective of isolating one or more dice from the shaken dice. The means for isolating the dice has generally taken the form of a shelf placed within a box and in such a position relative to the top of the box that the lid of the box when in place will prevent any dice placed on the shelf from being overturned or from sliding along the shelf during a subsequent shake of the remaining dice in the box.

Since the dice on the shelf must be kept out of the view of other players, there was substantial difficulty in transferring such dice from the main compartment of the box to the shelf and then getting the lid in place without those dice being seen by other players. This has generally been accomplished by opening the box to the minimum degree and sliding one's fingers into the box to make the transfer.

This has been unsatisfactory both from the point of view of being able to see clearly the dice in the box and being able to easily transfer the dice from the main compartment to the shelf.

Furthermore, games tend to be played in the evening when light is not at its best or, in the case of the highly portable Liar's Dice game, as well in public transportation waiting areas and the like. In all of these cases the lighting tends to be inadequate in that many modern homes utilize lamps rather than ceiling fixtures for most lighting and in that lighting in public areas tends to be subdued. This creates a substantial difficulty in the case of the present game, since it is necessary to open the box or similar apparatus to a limited extent only, in order to prevent other players from viewing the dice within the box. This combination of factors leads to the problem that it is often difficult to readily view the dice within the box. The consequent eye strain builds up over a period of time and tends to mitigate against the playing of the game.

The present invention is aimed at an apparatus which overcomes these problems by providing in one embodiment a means for preventing other players from viewing the interior of the apparatus and in another embodiment integral means for illuminating the interior of the apparatus.

PRIOR ART

As indicated above, the applicant is aware of an apparatus for playing the game comprising a box with a hinged lid and a shelf suspended in the box near the top, so that dice placed in the shelf are restrained by the closed lid from moving when the main compartment of the box containing the remaining dice is shaken.

U.S. Pat. No. 2,724,595, issued Nov. 22, 1955, to Amann, is in the general field of dice boxes and relates in particular to such a box having a hinged lid and an interior configuration which is of no relevance to the present case.

BRIEF SUMMARY OF THE INVENTION

It has now been discovered that the enjoyment level to be obtained from the Liar's Dice game can be greatly improved by providing a dice box having specific advantages over any prior art such boxes. In particular, in one embodiment of the invention integral illumination is provided such that the contents of the box are readily observable even where the background lighting level is low and where the box lid is raised by only a small amount.

A further advantage is obtained in a dice box having webbing extending downwardly from certain of the sides of the lid such that the box can be opened wider to prevent easier viewing while at the same time preventing other players from observing the contents.

Accordingly, in a first embodiment the invention provides a game apparatus comprising a container and a lid therefor, the container having therein a shaker section and a shelf section, the shelf section substantially isolated from the shaker section when the lid is in position on the container and having a bottom which is spaced a predetermined distance from the top of the container such that, when the lid is in place, a die lying on the shelf is restrained against movement when the apparatus is shaken; and an integral illumination system for illuminating the interior of the container.

In a further embodiment the invention provides a game apparatus comprising a container and a lid therefor, the container having therein a shaker section and a shelf section, the shelf section substantially isolated from the shaker section when the lid is in position on the container and having a bottom which is spaced a predetermined distance from the top of the container such that, when the lid is in place, a die lying on the shelf is restrained against movement when the apparatus is shaken; and wherein the lid is hingedly connected at one side to the container and includes a pair of protruding webs extending downwardly from the lid adjacent the hinged connection, the webs extending into the container when the lid is in the closed position, and blocking a lateral line of vision into the container when the lid is in the open position.

BRIEF SUMMARY OF THE DRAWINGS

In drawings which illustrate embodiments of the invention.

Figure 1:
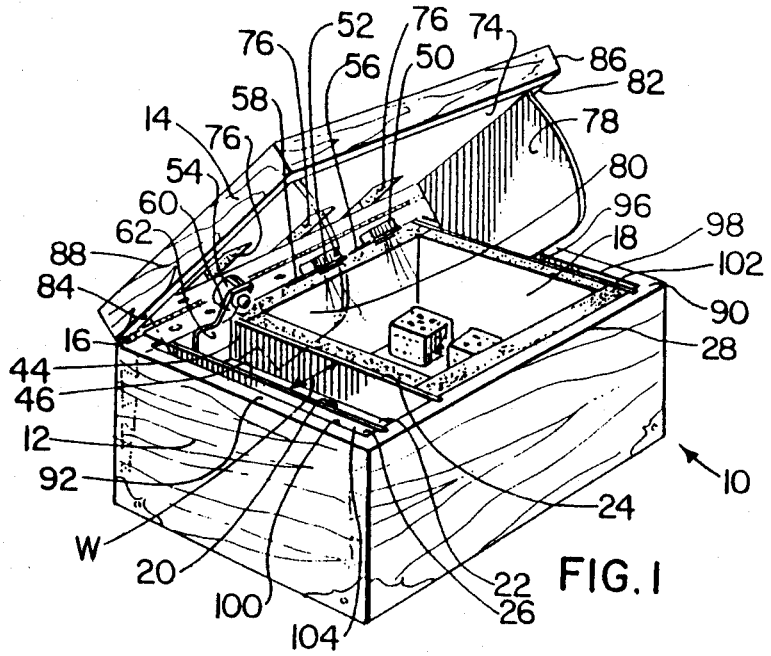
FIG. 1 is a top perspective view of an apparatus according to the invention.
Figure 2:
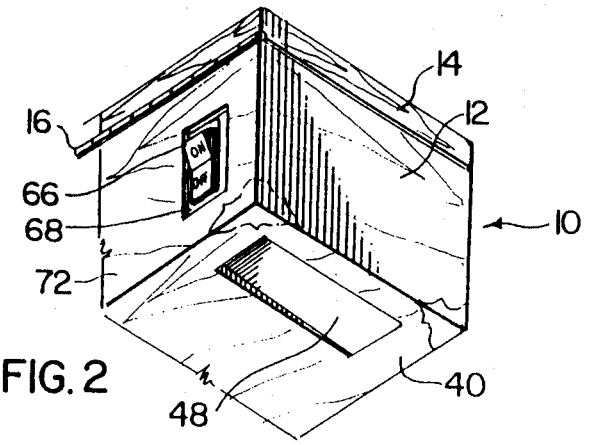
FIG. 2 is a partial bottom perspective view of the apparatus of FIG. 1.
Figure 3:
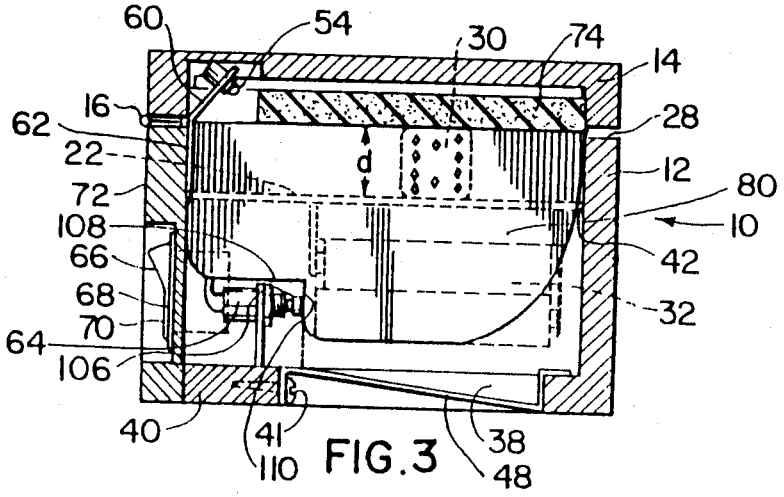
FIG. 3 is a section taken through one side of the apparatus of FIG. 1.
Figure 4:
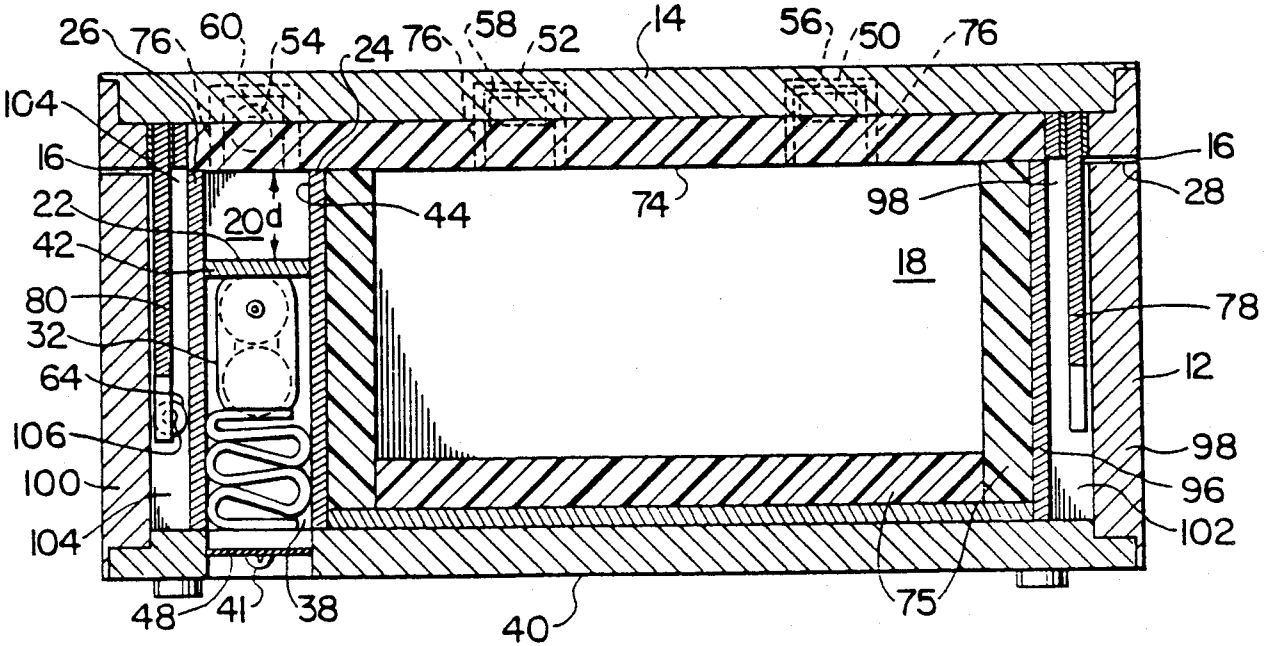
FIG. 4 is a section taken through the front of the apparatus of FIG. 3.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

The preferred configuration for the apparatus is that of a simple box 10 comprising the lower container 12 and the lid 14. The lid 14 is preferably attached to the container 12 by means of a hinge or hinges 16.

The specific shape of the box is not of critical importance. The basic shape was chosen for ease of construction and for aesthetic appeal, since the preferred material of construction is hardwood. However, if the shell was constructed of, for example, moulded plastic, various configurations could be utilized to incorporate the advantages of the invention.

Similarly, while the lid 14 is preferably hingedly connected to the container 12, it is not strictly necessary that the lid be connected in that way or at all.

The container 12 is divided into a shaker section 18 and a shelf section 20.

The shelf section 20 comprises a shelf 22 suspended by the webs 24 and 26 a predetermined distance "d" below the top 28 of container 12.

A die 30 is shown in place on the shelf 22. The distance "d" is chosen such that a die placed on shelf 22 will be held in place on shelf 22 by lid 14 when the lid is in a closed position, so that the die 30 or any other dice on shelf 22 will not be moved when the apparatus 10 is inverted or otherwise shaken. Both the shaker section 18 and the shelf section 20 are preferably lined as, for example, with a light foam material 74 and 75. This serves to reduce the noise of the rolling dice in the shaker section and to provide a snug fit for any dice in the shelf section. This latter point provides a double advantage in that the players other than the one controlling the box cannot determine when the shelf contains dice.

The webs 24 and 26 extend above the shelf 22 and preferably terminate adjacent the top 28 to provide lateral restraint to die 30 on shelf 22. In that regard the width "w" of shelf 22 is preferably similar to the distance "d", so that the die 30 is held securely in the shelf section 20.

In a preferred embodiment the invention includes an integral illumination system which comprises in general a power source 32, at least one light source 52 powered by the power source 32 and an on/off switch preferably activated and deactivated by opening and closing the lid 14.

The power source 32 is preferably a battery or battery pack housed in a compartment 38 opening into the bottom 40 of container 12. The battery or battery pack is preferably foam wrapped to prevent movement and/or damage or distraction during play. The compartment 38 is preferably located within the space defined by the lower side 42 of shelf 22, the inner sides 44 and 46 of webs 24 and 26, and a cover 48 which is secured to the bottom 40 of container 12, as, for example, by screw 41.

As illustrated, the apparatus 10 preferably includes as light source three light emitting diodes 50, 52 and 54. These are mounted on brackets 56, 58 and 60, respectively, which are in turn preferably integral with plate 62.

The on/off switch preferably comprises at least a lid activated switch 64 and preferably also a master switch 66.

The lid activated switch 64 is preferably a normally closed microswitch which may be mounted at any convenient place between the lid 14 and the container 12. A preferred location for this switch 64 will be discussed below relative to a further embodiment of the invention.

The master switch 66 may be of any conventional type but is preferably a rocker type switch mounted in a bracket 68 secured in an opening 70 in the side 72 of container 12. The opening 70 is positioned such that the rear side of the switch is adjacent the battery compartment 38.

The power source 32, the light sources 50, 52 and 54, and the intervening switch or switches 64 and/or 66 are then electrically connected in known manner.

In the preferred case the brackets 56, 58 and 60 project above the level of the top 28 of container 12 with the bracket 60 positioned above shelf section 20 and brackets 56 and 58 positioned above shaker section 18. Obviously in this configuration the plate 62 is secured along a side of container 12 and preferably along side 72 which is the hinged side.

In the configuration illustrated the lid 14 is preferably provided with a protective liner 74 which includes indentations 76 into which the brackets 56, 58 and 60 are received when the lid is in the closed position. The protective liner 74 is preferably a light foam material. The LEDs 50, 52 and 54 are thus protected from physical damage caused by the tumbling dice when the container is being shaken.

While other means of protecting the LEDs can be utilized, the use of a protective liner 74 is preferred, since that liner also serves to absorb noise associated with the shaking of the dice. In the preferred case the shaker section 18 and the shelf section 20 are also lined with a protective and sound absorbing material 75 such as a light resilient foam or self adhesive felt.

In a further embodiment of the invention, which may or may not include the illumination system, the lid 14 is provided with a pair of depending webs 78 and 80. In the closed position of lid 14 the webs are housed within container 12. As the lid is rotated open on hinge 16, the webs 78 and 80 act as a screen between the lower edges 82 and 84 of the ends 86 and 88 respectively of lid 14 and the corresponding edges 90 and 92 of the top 28 of container 12. Accordingly, the lid 14 can be opened for a substantial distance to allow an observer from the front 94 of container 12 to have a clear view of the contents of container 12 while preventing players to the sides from observing the contents.

In the case of a lid which is not connected by hinges to container 12, a third depending web (not shown) may be included on the lid on the otherwise hinged side.

As in the case of the illumination, the inclusion of the webs permits the game to be played in a much more comfortable fashion, since a player can concentrate on the contents of the container 12 and on his play rather than on the difficulty of preventing other players from observing the contents of the box.

In the preferred configuration the container 12 includes an additional web 96 which, together with web 26 and the end walls 98 and 100 define narrow cavities 102 and 104. When the lid 14 is in the closed position, the webs 78 and 80 (the latter shown for convenience in ghosted lines) are preferably housed within cavities 102 and 104 and thus avoid any interference with the interior of shaker section 18.

In the most preferred configuration, the lid activated switch 64 is positioned having its spring biased activation button 106 within the cavity 104. The web 80 is profiled at 108 to enable web 80 to be substantially closed without interference with switch 66 but to allow the edge 110 of profile 108 to contact and to press button 106 as lid 14 reaches the fully closed position. Switch 64 is thus conveniently positioned adjacent the master switch 66 and the power source 32 and may conveniently be mounted on the back of bracket 68.

This most preferred embodiment offers not only the advantages of the web 78 and 80, but also provides illumination to the interior of the container 12 which is often needed because of low background lighting but is needed even more so in the situation where the interior of container 12 is additionally shaded by webs 78 and 80.

Thus it is apparent that there has been provided in accordance with the invention a game apparatus that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A game apparatus comprising:

a container and al id therefor; said lid moveable between an open and a closed position; said container having therein a shaker section and a shelf section; said shelf section substantially isolated from said shaker section when said lid is in said closed position on said container and having a bottom which is spaced a predetermined distance from the top of said container such that, when said lid is in said closed position, a die lying on the said shelf is restrained against movement when said apparatus is shaken; and an integral illumination system for illuminating the interior of said container;

and wherein said illumination system comprises:

a power source;

at least one light source electrically connected to receive power from said power source; and an on/off switch mounted to be activated by moving said lid between said open and closed positions and connected electrically to control current flow between said power source and said light source.

2. The apparatus of claim 1 including a second on/off switch for manual activation by a user for controlling current flow between said power source and said light source.

3. The apparatus of claim 1 including at least two said light sources.

4. The apparatus of claim 3 wherein at least one said light source is mounted to illuminate said shaker section and at least one said light source is mounted to illuminate said shelf section.

5. The apparatus of claim 1 wherein each said light source is mounted on said container.

6. The apparatus of claim 5 wherein each said light source is mounted to project above the top of said container.

7. The apparatus of claim 6 wherein said lid includes means to protect said light sources against physical damage when said lid is in said closed position on said container.

8. The apparatus of claim 7 wherein said lid is lined with protective material having open cavities therein corresponding to each said light source such that each said light source is substantially laterally encased by said protective material when said lid is in position on said container.

9. The apparatus of claim 8 wherein said protective material is foam.

10. The apparatus of claim 7 wherein said lid is hingedly connected to said container.

11. The apparatus of claim 1 wherein each said light source is a light emitting diode.

12. The apparatus of claim 1 wherein said power source is a battery.

13. A game apparatus comprising:

a container and a lid therefor; said lid moveable between an open and a closed position; said container having therein a shaker section and a shelf section when said lid is in said closed position on said container and having a bottom which is spaced a predetermined distance from the top of said container such that, when said lid is in said closed position, a die lying on the said shelf is restrained against movement when said apparatus is shaken; and an integral illumination system for illuminating the interior of said container;

and wherein said lid is hingedly connected at one side to said container and includes a pair of protruding webs extending downwardly from said lid adjacent said hinged connection, said webs extending into said container when said lid is in the closed position, and blocking a lateral line of vision into said container when said lid is in the open position.

14. The apparatus of claim 13 wherein said container and said lid are of rectangular configuration and wherein said webs protrude from the two sides of said lid which lie perpendicular to said one side.

15. A game apparatus comprising;

a container and a lid therefor;

said lid moveable between an open and a closed position;

said container having therein a shaker section and a shelf section; said shelf section substantially isolated from said shaker section when said lid is in position on said container and having a bottom which is spaced a predetermined distance from the top of said container such that, when said lid is in said closed position, a die lying on the said shelf is restrained against movement when said apparatus is shaken; and wherein said lid is hingedly connected at one side to said container and includes a pair of protruding webs extending downwardly from said lid adjacent said hinged connection, said webs extending into said container when said lid is in the closed position and blocking a lateral line of vision into said container when said lid is in the open position.

16. The game apparatus of claim 15 wherein said container and said lid are of rectangular configuration and wherein said webs protrude from the two sides of said lid which lie perpendicular to said one side.

* * * * *